US007731642B2

(12) United States Patent
Kashiwaya

(10) Patent No.: US 7,731,642 B2
(45) Date of Patent: Jun. 8, 2010

(54) TRAINING APPARATUS

(75) Inventor: Yoshihisa Kashiwaya, Tokyo (JP)

(73) Assignee: Senoh Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/330,793

(22) Filed: Dec. 9, 2008

(65) Prior Publication Data

US 2009/0227430 A1 Sep. 10, 2009

(30) Foreign Application Priority Data

Mar. 7, 2008 (JP) ..... 2008-057188

(51) Int. Cl.
*A63B 21/00* (2006.01)
*A63B 21/06* (2006.01)
*A63B 21/062* (2006.01)

(52) U.S. Cl. ..... 482/136; 482/93; 482/100; 482/133

(58) Field of Classification Search ..... 482/93, 482/100, 126, 133, 135, 138, 908, 136
See application file for complete search history.

(56) References Cited

U.S. PATENT DOCUMENTS 4,757,992 A * 7/1988 Heitsch et al. ..... 482/136
4,817,943 A * 4/1989 Pipasik ..... 482/97
4,878,663 A * 11/1989 Luquette ..... 482/100
4,949,951 A * 8/1990 Deola ..... 482/138
5,391,132 A * 2/1995 Greenwald ..... 482/91
6,149,612 A * 11/2000 Schnapp et al. ..... 601/23
6,554,234 B2 * 4/2003 Holdren ..... 248/118.5
7,128,695 B2 * 10/2006 Panatta ..... 482/100

FOREIGN PATENT DOCUMENTS

JP 2007-319524 A 12/2007
WO WO 2004009184 A1 * 1/2004

* cited by examiner

*Primary Examiner*—Loan H Thanh
*Assistant Examiner*—Allana Lewin
(74) *Attorney, Agent, or Firm*—Bachman & LaPointe, P.C.

(57) ABSTRACT

A training apparatus including an operation part to which a load is applied for performing a training of a front deltoid muscle, a pectoralis major muscle and a triceps brachii muscle. The training apparatus includes a pair of armrests on which trainee's forearms are to be rested, and a pair of grips provided to the operation part and having lower end sections. In the training apparatus, the armrests have surfaces on which the trainee's forearms are to be rested, at a height of the lower end sections of the grips.

17 Claims, 5 Drawing Sheets

TRAINING APPARATUS

BACKGROUND OF THE INVENTION

This invention relates to improvements in a training apparatus for training or exercising a muscle of a certain body part, particularly the front deltoid muscle, the pectoralis major muscle and the triceps brachii muscle.

A conventional training machine for exercising the front deltoid muscle, the pectoralis major muscle and the triceps brachii muscle, which is proposed in Japanese Patent Provisional Publication No. 2007-319524, is illustrated in FIG. 4 by reference numeral 2.

As shown in FIG. 4, the training machine 2 is provided including an operation part 3' and a load application device 4'. The operation part 3' is provided with operation arms 5*a*', 5*b*' and a seat section 6', as shown in FIG. 5.

The operation arms 5*a*', 5*b*' are provided in a pair as shown in FIG. 5 and are connected respectively to rotational shafts 8*a*', 8*b*' erected on a frame 7' (illustrated in FIG. 4 and supporting the seat section 6' and the load application device 4'). The rotational shafts 8*a*', 8*b*' are disposed parallel to each other under the seat section 6', in such a manner as to be rotatable cooperative with each other in the directions reverse to each other, thereby allowing a cooperative rotation.

The operation arm 5*a*' is operated by a user or trainee 9' (as shown in FIG. 5, who intends to exercise his front deltoid muscle, pectoralis major muscle and triceps brachii muscle) with his right hand, and additionally provided with a main arm 31*a*' and a grip 32*a*'. The main arm 31*a*' is secured at its lower end portion to a circumferential side surface of the rotational shaft 8*a*'. The grip 32*a*' is erected on a connection plate 34*a*' pivotally attached to an upper end portion of the main arm 31*a*' through a pivot shaft 33*a*', in such a manner as to be adjustable for position at which a pivotal motion of the grip 32*a*' about the pivot shaft 33*a*' starts. Additionally, a drive section 37' which is linked to a cable 36' is connected to the rotational shaft 8*a*' as shown in FIG. 4. The cable 36' is linked to a sheave 35' rotationally supported on the frame 7'. To the sheave 35', a load caused by weight blocks 101' disposed in a housing 102' of the load application device 4' is applied through pulleys 104', 105' and a circular cum 106'.

The operation arm 5*b*', which is arranged generally symmetrical to the operation arm 5*a*', is operated by the user 9' with his left hand and additionally provided with a main arm 31*b*' and a grip 32*b*'. The main arm 31*b*' is attached at its lower end portion to a side surface of the rotational shaft 8*b*' and provided at its upper end portion with the grip 32*b*' as shown in FIG. 5. The grip 32*b*' is erected on a connection plate 34*b*' pivotally attached to the upper end portion of the main arm 31*b*' through a pivot shaft 33*b*', symmetrically similarly to the grip 32*a*'. The grip 32*b*' is adjustable for position at which a pivotal motion of the grip 32*b*' about the pivot shaft 33*b*' starts.

In training the front deltoid muscle, the pectoralis major muscle and the triceps brachii muscle, first of all, the user seats himself on a seat 41' and rests his feet on a footrest 44' while bringing his back and lower back into contact with a back pad 43' and a lower back pad 42', respectively. Then, a start position of rotation of the operation arms 5*a*', 5*b*' is adjusted with an assist bar 45' according to the user's own will. Then, the user 9' grasps the grips 32*a*', 32*b*' and rotationally moves the main arms 31*a*', 31*b*' about the rotational shafts 8*a*', 8*b*'. With this, the user's muscles of certain body parts, particularly the front deltoid muscle, the pectoralis major muscle and the triceps brachii muscle are brought under loaded conditions caused by the weight blocks 101', thereby achieving the training thereof. The position of the seat section 6' is adjustable in a vertical direction by means of a vertically adjusting lever 51' and in a fore-and-aft direction by means of a fore-and-aft adjusting lever 52' so that the user can perform the training in accordance with his physique.

SUMMARY OF THE INVENTION

However, drawbacks have been encountered in conventional training machines. More specifically, when a beginner performs the training of the front deltoid muscle, the pectoralis major muscle and the triceps brachii muscle by using the training machine 2, both forearms of him tend to be located lower than the grips 32*a*', 32*b*' as shown in FIG. 5. In this case the load caused by the weight blocks 101' tends to be applied to both upper arms, and therefore sometimes the beginner cannot perform an effective training of the front deltoid muscle, the pectoralis major muscle and the triceps brachii muscle without assistance of a trainer.

In view of the above, an object of the present invention is to provide an improved training apparatus for training or exercising the front deltoid muscle, the pectoralis major muscle and the triceps brachii muscle which apparatus can effectively overcome drawbacks encountered in the conventional training machines.

An aspect of the present invention resides in a training apparatus including an operation part to which a load is applied for performing a training of a front deltoid muscle, a pectoralis major muscle and a triceps brachii muscle. The training apparatus comprises a pair of armrests on which trainee's forearms are to be rested, and a pair of grips provided to the operation part and having lower end sections. In this training apparatus, the armrests have surfaces on which the trainee's forearms are to be rested, at the height of the lower end sections of the grips.

DETAILED DESCRIPTION OF THE INVENTION

Figure 1:
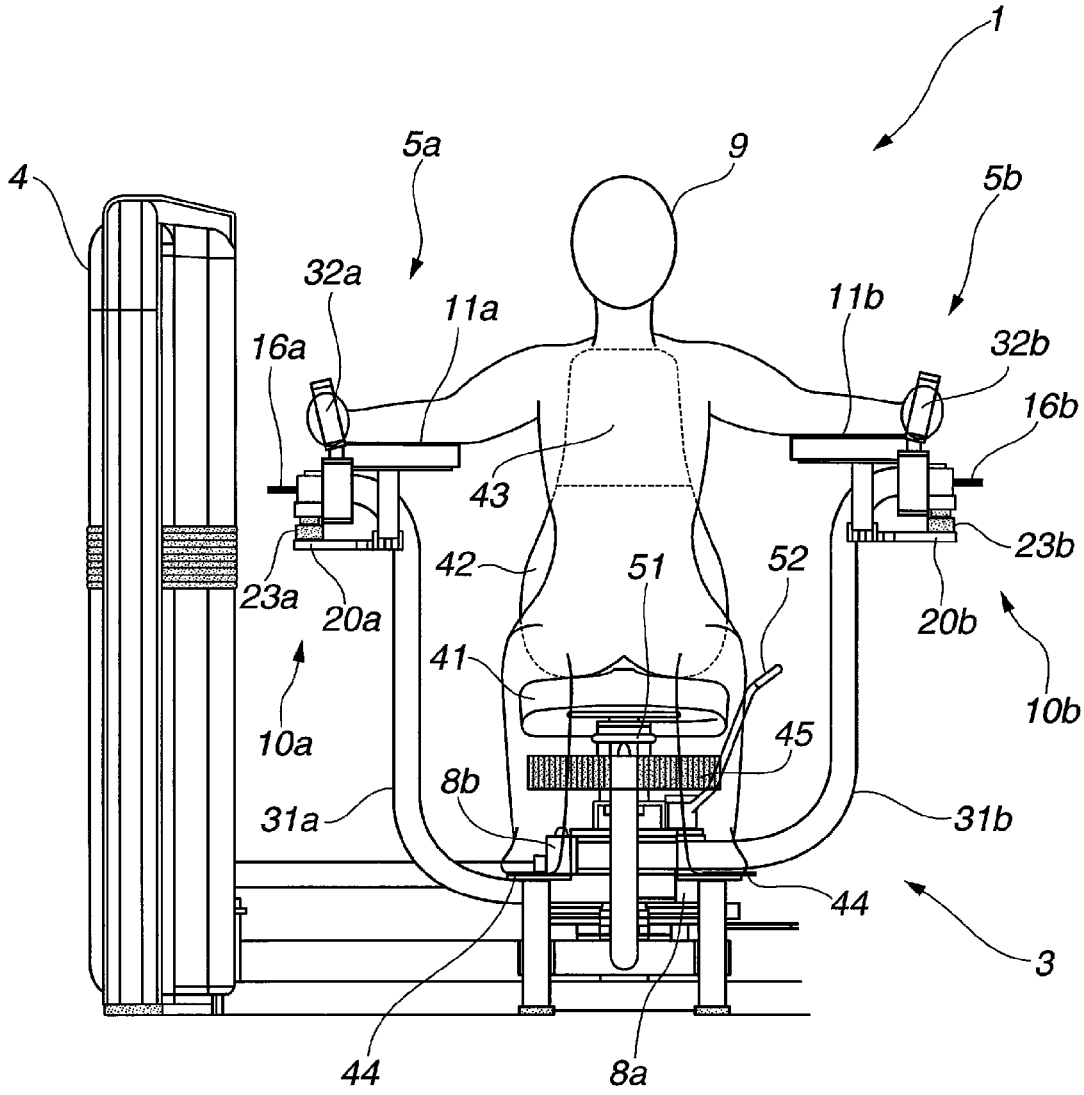
FIG. 1 is a front view of an embodiment of a training apparatus according to the present invention.

Referring now to FIG. 1, an embodiment of a training apparatus according to the present invention is illustrated by the reference numeral 1.

Figure 4:
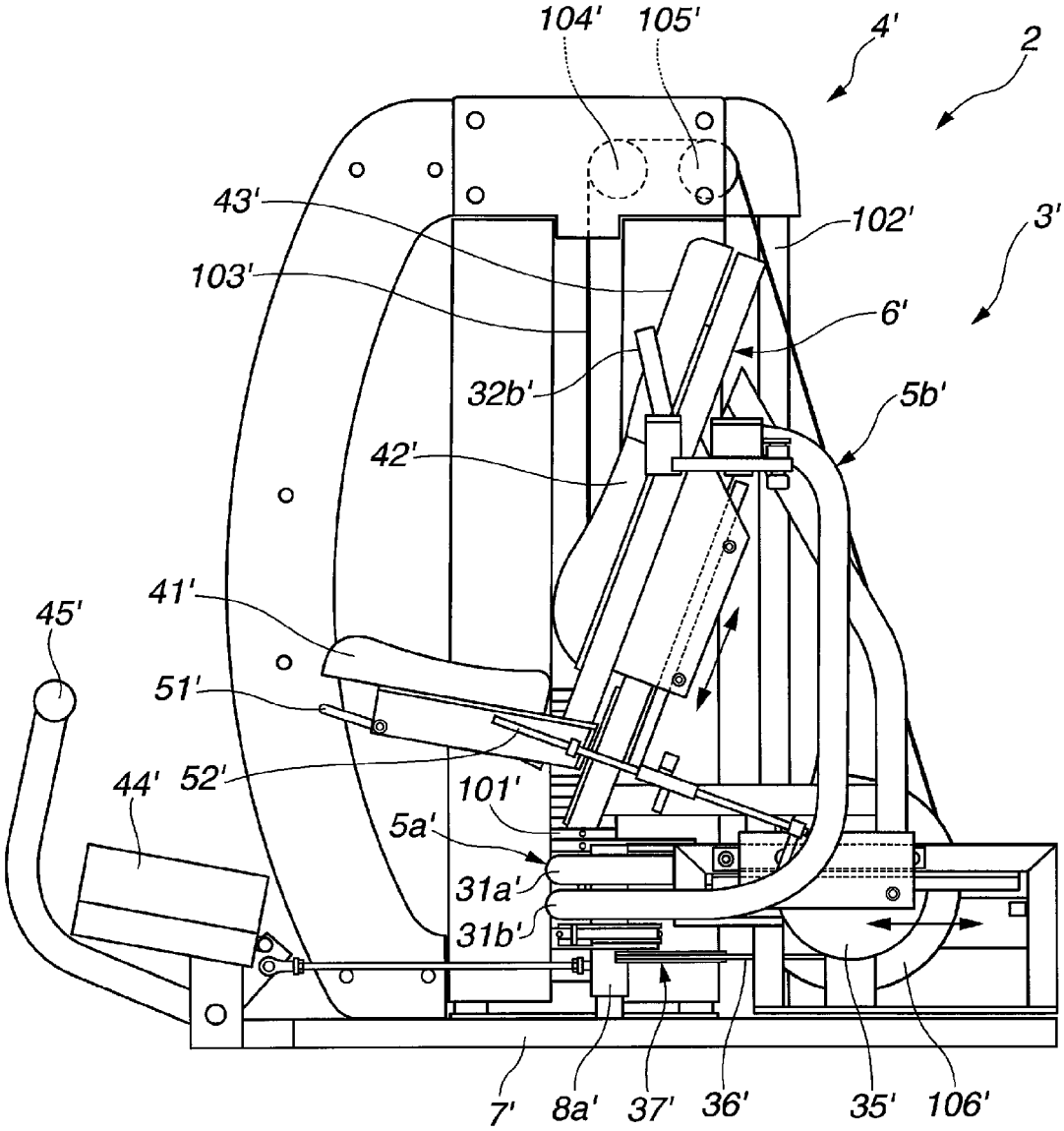
FIG.4 (PRIOR ART)
FIG. 4 is a side view of a conventional training machine.
Figure 5:
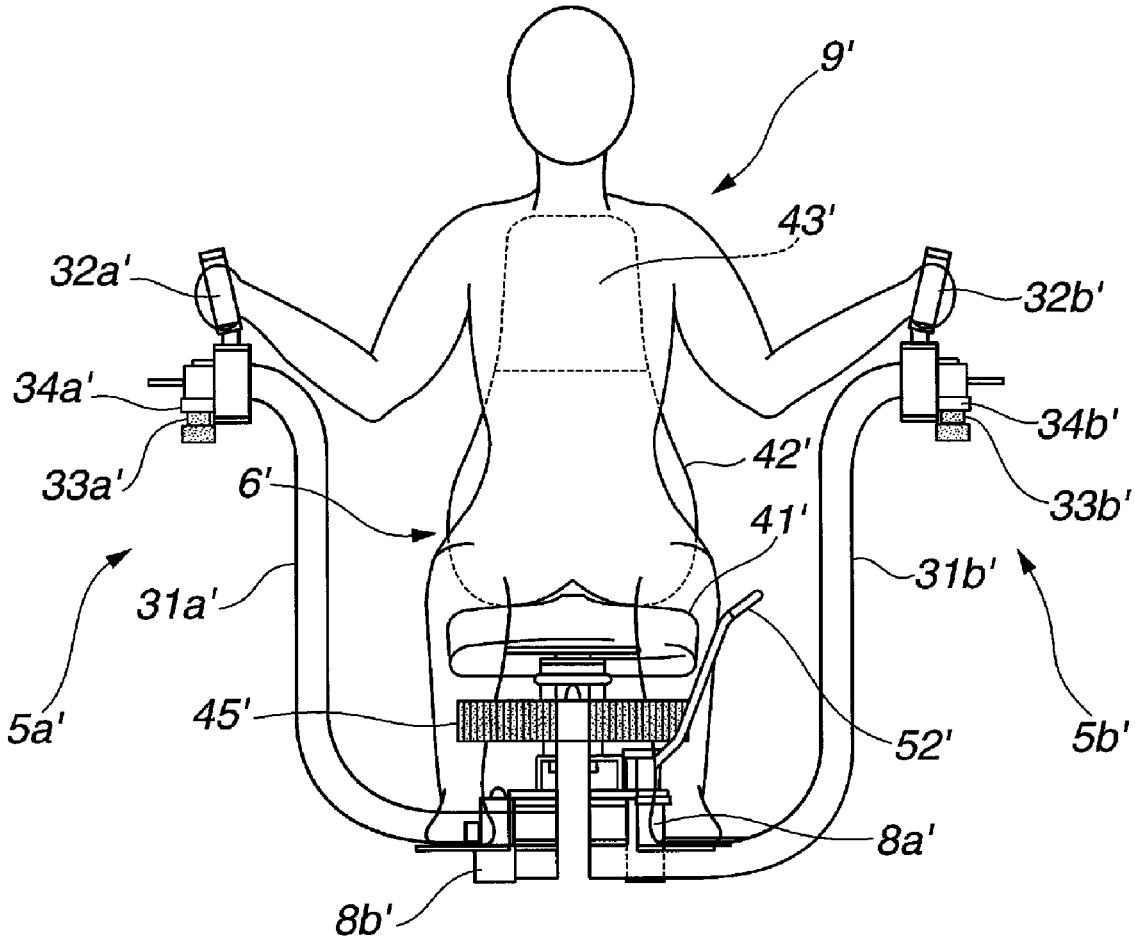
FIG.5 (PRIOR ART)
FIG. 5 is a front view of the conventional training machine of FIG. 4, for exemplifying an operation of the conventional training machine.

As shown in FIG. 1, the training apparatus 1 includes operation arms 5*a*, 5*b* relating to a conventional training machine 2 as shown in FIG. 4 and therefore arranged generally symmetrical to each other. More specifically, the operation arms 5*a*, 5*b* are respectively connected to rotational shafts 8*a*, 8*b* erected on a frame 7 supporting a seat section 3 and a load application device 4. The rotational shafts 8*a*, 8*b* are disposed parallel to each other under the seat section 3, in such a manner as to be rotatable cooperative with each other in the directions reverse to each other. The operation arms 5*a*, 5*b* are provided with right-side and left-side armrests 10*a*, 10*b*, respectively. The operation arm 5*a* is further provided with a main arm 31*a* and a grip 32*a*.

Figure 3A:
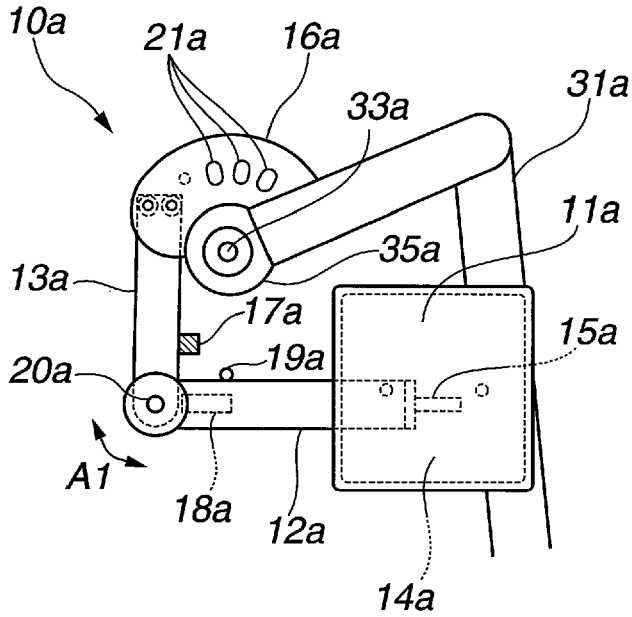
FIG. 3A is a fragmentary plan view of the training apparatus of FIG. 1, showing a right-side armrest provided to the training apparatus.
Figure 3C:
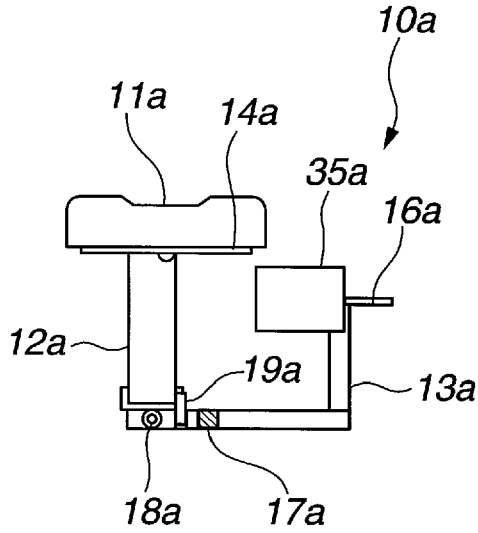
FIG. 3C is a side view of the right-side armrest of FIG. 3A.
Figure 3B:
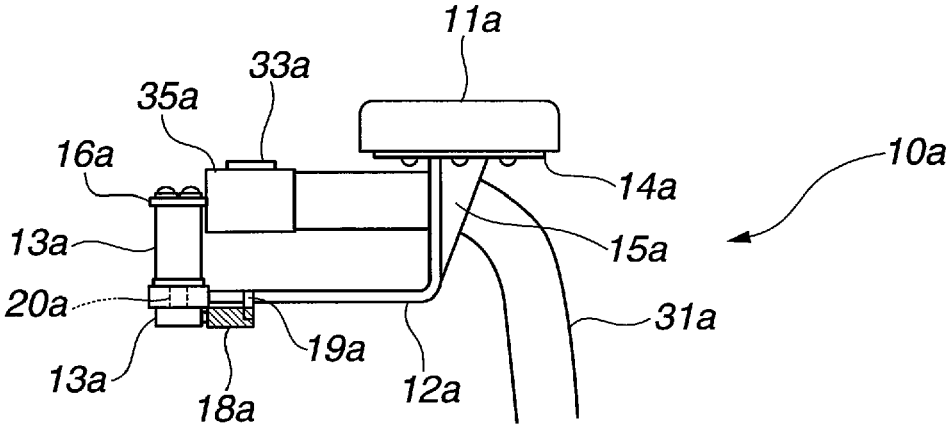
FIG. 3B is a front view of the right-side armrest of FIG. 3A.

FIG. 3A is a fragmentary plan view of the training apparatus of FIG. 1, showing the right-side armrest 10*a* provided to the training apparatus. FIG. 3B is a front view of the right-side armrest 10*a*, and FIG. 3C is a side view of the right-side armrest 10*a*. As shown in FIGS. 3A, 3B and 3C, the right-side armrest 10*a* is provided having a right-side armrest pad 11*a*, a pad arm 12*a* and a connection arm 13*a*.

The right-side armrest pad 11*a* is a pad having a surface on which a user can rest his right forearm at the time of training the front deltoid muscle, the pectoralis major muscle and the triceps brachii muscle. Additionally, the right-side armrest pad 11*a* is supported by the pad arm 12*a* in such a manner that the surface on which the user's right forearm is to be rested is at the height of a lower end section of the grip 32*a*. The pad arm 12*a* comprises a plate formed generally L-shaped in section, and a mounting plate 14*a* is horizontally attached to one end of the pad arm 12*a*, as shown in FIG. 3B. The right-side armrest pad 11*a* is attached mounted on the mounting plate 14*a*. Further, the mounting plate 14*a* is accessorily supported by a support plate 15*a*.

As shown in FIG. 3C, the pad arm 12*a* is connected to an adjusting plate 16*a* through the connection arm 13*a* comprising a plate formed generally L-shaped in section. Additionally, the pad arm 12*a* is connected through a bearing (not shown) to a pivot 20*a* erected on one end portion of the connection arm 13*a* as shown in FIGS. 3A and 3B, in such a manner as to be pivotable about the pivot 20*a* in directions indicated by an arrow A1.

The pivot range in the directions indicated by the arrow A1 is restricted by stoppers 17*a*, 18*a* and a contacted member 19*a* as shown in FIG. 3A. The stopper 17*a* is connected to a side surface of the connection arm 13*a* to be located where the connection arm 13*a* is to face the right-side armrest pad 11*a*. Meanwhile, the stopper 18*a* is connected to the side surface of the connection arm 13*a* to be located near the one end portion of the connection arm 13*a* and under the pad arm 12*a* as shown in FIG. 3B. The contacted member 19*a* is connected to a side surface of the pad arm 12*a* and arranged to be brought into contact with the stopper 17*a* when the pad arm 12*a* is pivotally moved about the pivot 20*a* in a counterclockwise direction (one of the directions indicated by an arrow A1), while brought into contact with the stopper 18*a* when the pad arm 12*a* is pivotally moved about the pivot 20*a* in a clockwise direction (the other of the directions indicated by an arrow A1).

Figure 2:
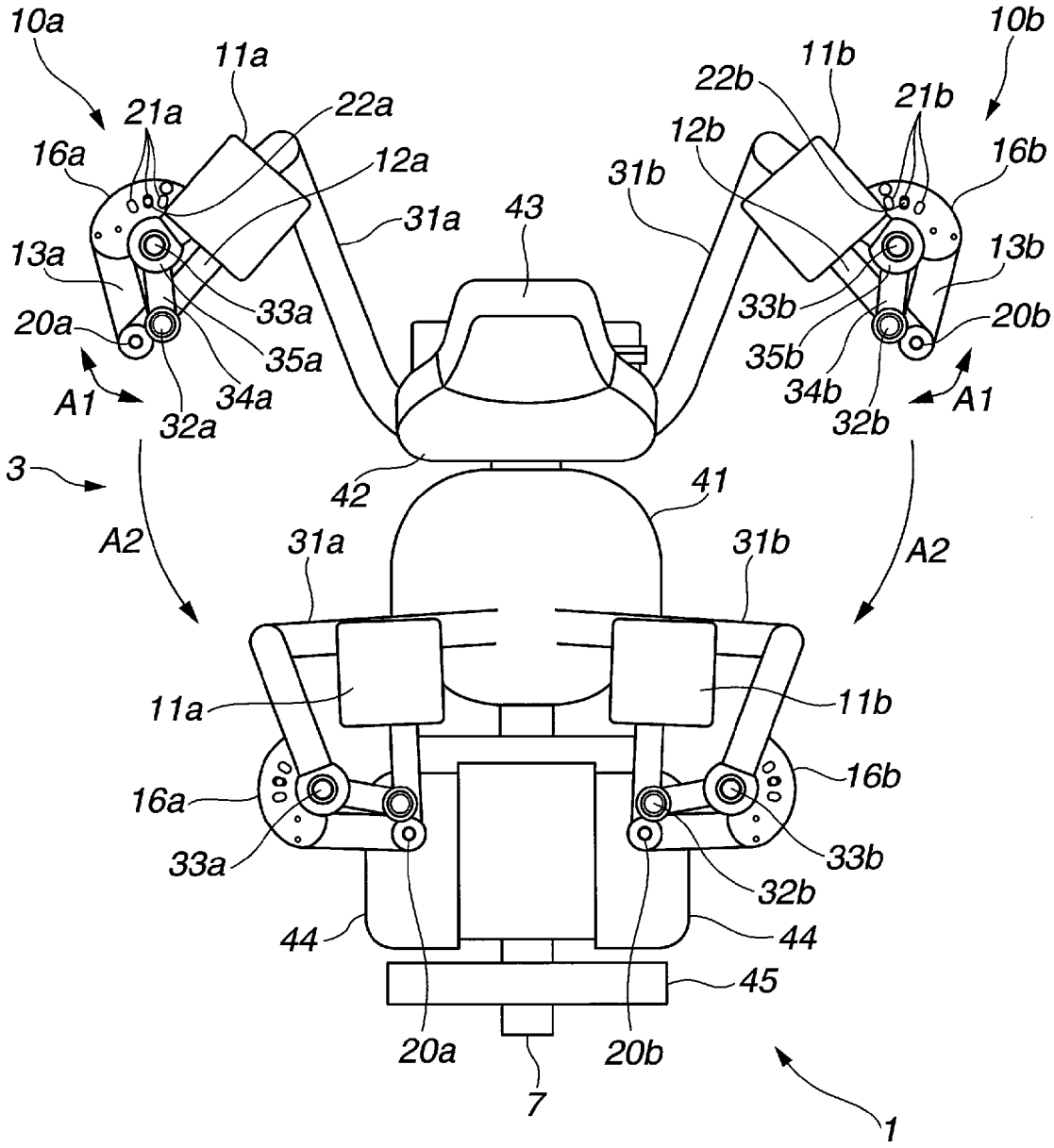
FIG. 2 is a plan view of the training apparatus of FIG. 1, for exemplifying an operation of the training apparatus.

As shown in FIGS. 3A, 3B and 3C, the connection arm 13*a* is, at the other end portion, detachably attached to the adjusting plate 16*a* with screws. The adjusting plate 16*a* is fixed welded to the main arm 31*a* and a sleeve 35*a* connected to an upper end portion of the main arm 31*a*. The sleeve 35*a* supports a pivot shaft 33*a* of the grip 32*a* such that the pivot shaft 33*a* is pivotable in a condition of being vertically disposed with respect to the floor. The adjusting plate 16*a* is formed with a plurality of elongated openings 21*a* with which a starting position of a pivotal motion of the grip 32*a* can be selected as shown in FIG. 2, in such a manner that the elongated openings 21*a* are aligned coaxial with the axis of the pivot shaft 33*a*. Then, a pin 22*a* illustrated in FIG. 2 and biased by a spring (not shown) is inserted into any one of the elongated openings 21*a* by operating a knob 23*a* illustrated in FIG. 1.

The left-side armrest 10*b* is the pair to the right-side armrest 10*a* and arranged generally symmetrical to the same. More specifically, a left-side armrest pad 11*b*, a pad arm 12*b* and a connection arm 13*b* as shown in FIG. 2 and included in the left-side armrest 10*b* have the same structures as the right-side armrest pad 11*a*, the pad arm 12*a* and the connection arm 13*a* have, respectively, except for being designed to be left-handed.

Referring now to FIGS. 1 and 2, an example of an operation of the training apparatus 1 will be discussed.

At the beginning of training the front deltoid muscle, the pectoralis major muscle and the triceps brachii muscle in the use of the training apparatus 1, a user 9 adjusts the position of the seat section 3 in vertical directions by operating a vertically adjusting lever 51, and in fore-and-aft directions by operating a fore-and-aft adjusting lever 52, in accordance with his physique.

Then, the starting position of the pivotal motion of the grips 32*a*, 32*b* is determined according to the user's demand. For example, the starting position of the pivotal motion of the grip 32*a* is determined in such a manner that the user 9 inserts the pin 22*a* into any one of the elongated openings 21*a* by operating the knob 23*a* (illustrated in FIG. 1), as shown in FIG. 2. Similar to this, the starting position of the pivotal motion of the grip 32*b* is determined by the user's choice, in such a manner that the user 9 inserts a pin 22*b* into any one of elongated openings 21*b* by operating a knob 23*b* (illustrated in FIG. 1), as shown in FIG. 2.

Thereafter, the user 9 seats himself on a seat 41 and rests his feet on a footrest 44 while bringing his back and lower back into contact with a back pad 43 and a lower back pad 42, respectively, as shown in FIG. 1. Subsequently, the user 9 rests his right and left forearms on the right-side and left-side armrest pads 11*a*, 11*b*, respectively. The right-side and left-side armrest pads 11*a*, 11*b* are provided to be pivotable respectively about the pivots 20*a*, 20*b* in the directions indicated by the arrow A1 in FIG. 2, so that the user 9 can adjust the position of them in accordance with his physique. Further, a start position of rotation of the operation arms 5*a*, 5*b* is adjusted with an assist bar 45 according to the user's own will.

When the user 9 pushes the grips 32*a*, 32*b* in directions indicated in FIG. 2 by arrows A2, the main arms 31*a*, 31*b* are rotationally moved about the rotational shafts 8*a*, 8*b* illustrated in FIG. 1. At this time, the right and left forearms of the user 9 are kept in position since these are supported respectively on the right-side and left-side armrest pads 11*a*, 11*b*, with which a load determined by the use of weight blocks disposed in the load application device 4 is evenly applied only to the front deltoid muscle, the pectoralis major muscle and the triceps brachii muscle. Therefore, the user 9 is able to effectively exercise muscles of certain body parts without assistance of a trainer.

When the grips 32*a*, 32*b* pushed forward are released back slowly by the user 9, the load determined by the use of the weight blocks is applied to the certain body parts again. Therefore, a further effective training of the certain body parts is allowed.

With the training apparatus 1 according to the present invention, it is thus allowed, even if the user 9 is a beginner, to effectively perform the training of the front deltoid muscle, the pectoralis major muscle and the triceps brachii muscle without assistance of the trainer.

Further, technical ideas (a) to (c) grasped from the above embodiment will be discussed together with effects obtained therein.

(a) A training apparatus including an operation part to which a load is applied for performing a training of a front deltoid muscle, a pectoralis major muscle and a triceps brachii muscle comprises: a pair of armrests on which trainee's forearms are to be rested; and a pair of grips provided to the operation part and having lower end sections. In this training apparatus, the armrests have surfaces on which the trainee's forearms are to be rested, at the height of the lower end sections of the grips. According to the technical idea (a), the operation part is operated under a condition where the trainee's forearms are generally at the height of the grips, so that the load is applied only to the front deltoid muscle, the pectoralis major muscle and the triceps brachii muscle.

(b) In the training apparatus as discussed in the technical idea (a), the armrests comprise armrest pads having surfaces on which the trainee's forearms are to be rested, the surfaces of the armrest pads being at the height of the lower end sections of the grips.

(c) In the training apparatus as discussed in the technical idea (b), the training apparatus further comprises pivots erected respectively near the grips, and additionally the armrest pads are provided to be pivotable respectively about the pivots. According to the technical idea (c), it is allowed to adjust the position of the armrest pad in accordance with the trainee's physique.

The entire contents of Japanese Patent Application P2008-057188 (filed Mar. 7, 2008) are incorporated herein by reference.

Although the invention has been described above by reference to certain embodiments and examples of the invention, the invention is not limited to the embodiments and examples described above. Modifications and variations of the embodiments and examples described above will occur to those skilled in the art, in light of the above teachings. The scope of the invention is defined with reference to the following claims.

What is claimed is:

1. A training apparatus including an operation part to which a load is applied for performing a training of a front deltoid muscle, a pectoralis major muscle and a triceps brachii muscle, the training apparatus comprising:

a pair of armrests on which trainee's forearms are to be rested;

a pair of grips provided to the operation part and having lower end sections; and pivots erected respectively near the grips, wherein:

the armrests have surfaces on which the trainee's forearms are to be rested, the surfaces being at a height of the lower end sections of the grips;

the armrests comprise armrest pads having said surfaces on which the trainee's forearms are to be rested, the surfaces being at the height of the lower end sections of the grips;

the armrest pads are provided to be pivotable respectively about the pivots relative to associated main arms of the operational part;

for each of the arms, the apparatus comprises two stoppers and a contacted member which cooperate to restrict a pivotal motion of the armrest pad about its associated pivot; and the contacted member is arranged to be brought into contact with one of the two stoppers upon the pivotal motion of the armrest pad in one direction and brought into contact with the other of the two stoppers upon the pivotal motion of the armrest pad in an opposite direction.

2. The training apparatus as claimed in claim 1, further comprising a seat and a back pad.

3. The training apparatus as claimed in claim 1, wherein the grips are erect with respect to the surfaces of the armrests on which the trainee's forearms are to be rested.

4. The training apparatus as claimed in claim 1, further comprising pivot shafts pivotably and vertically disposed, wherein the grips are pivotable about axes of the pivot shafts.

5. The training apparatus as claimed in claim 4, further comprising a pair of main arms each of which have one end portion at which the respective pivot shafts are pivotably supported, wherein the main arms are rotationally moveable about a pair of rotational shafts, respectively.

6. The apparatus of claim 1, wherein the operation part is configured to permit the trainee to:

grip the grips while resting the respective forearms on the armrest; and push the grips forward of the trainee to perform said training of said front deltoid muscle, pectoralis major muscle, and triceps brachii muscle of each side of the trainee's body.

7. A method for using the apparatus of claim 1 by the trainee, comprising:

sitting on a seat, gripping the grips, and resting the respective forearms on the armrest; and pushing the grips forward of the trainee to perform said training of said front deltoid muscle, pectoralis major muscle, and triceps brachii muscle of each side of the trainee's body.

8. A training apparatus comprising:

a load application device (4); and an operational part (3) coupled to the load application device and comprising:

a pair of main arms (31*a*, 31*b*) rotatable about axes of associated rotational shafts (8*a*, 8*b*);

a pair of armrests (10*a*, 10*b*) each mounted for rotation about an associated pivot (20*a*, 20*b*) relative to an associated said main arm; and a pair of handgrips (32*a*, 32*b*), wherein a trainee may grip the handgrips and while resting respective forearms on the arm rests and push the handgrips to rotate the main arms about the axes of the associated rotational shafts, wherein the operational part further comprises:

a pair of connection arms (13*a*, 13*b*) respectively coupled to associated said armrests at the associated said pivot (20*a*, 20*b*); and a pair of adjusting plates (16*a*, 16*b*) each having a plurality of openings (21*a*, 21*b*) for receiving a pin (22*a*, 22*b*), the pins accommodating the opening so as to determine an associated relative position of each grip about an axis of an associated pivot (33*a*, 33*b*) relative to the associated main arm.

9. The apparatus of claim 8 wherein the operational part further comprises:

a seat (41); and a back pad (42, 43).

10. The apparatus of claim 8 wherein:

the load application device comprises a plurality of weight blocks.

11. The apparatus of claim 8 wherein:

the pair of armrests comprise a pair of pads (11*a*, 11*b*); and the pads are respectively supported by an associated pair of arms (12*a*, 12*b*).

12. A method for using the apparatus of claim 8 comprising the trainee:

sitting on a seat, gripping the handgrips and resting the respective forearms on the armrests; and pushing the handgrips to rotate the main arms.

13. The method of claim 12 further comprising:

adjusting a position of the armrests by pivoting them respectively about the pivots (20*a*, 20*b*).

14. The method of claim 12 further comprising:

selecting, via engaging said pin (22*a*, 22*b*) in one of said plurality of openings (21*a*, 21*b*) for each of the main arms, said associated relative position of each grip.

15. A training apparatus including an operation part to which a load is applied for performing a training of a front deltoid muscle, a pectoralis major muscle and a triceps brachii muscle, the training apparatus comprising:

a pair of armrests on which trainee's forearms are to be rested;

a pair of grips provided to the operation part and having lower end sections;

pivot shafts pivotably and vertically disposed; and a pair of main arms each of which have one end portion at which the respective pivot shafts are pivotably supported, wherein:

the main arms are rotationally moveable about a pair of rotational shafts, respectively;

the grips are pivotable about axes of the pivot shafts; and the armrests have surfaces on which the trainee's forearms are to be rested, the surfaces being at a height of the lower end sections of the grips.

16. The training apparatus as claimed in claim 15, further comprising a seat and a back pad.

17. The apparatus of claim 16, wherein the operation part is configured to permit the trainee to:

grip the grips while resting the respective forearms on the armrest; and push the grips forward of the trainee to perform said training of said front deltoid muscle, pectoralis major muscle, and triceps brachii muscle of each side of the trainee's body.

* * * * *